US006171696B1

(12) United States Patent
Takemura et al.

(10) Patent No.: US 6,171,696 B1
(45) Date of Patent: Jan. 9, 2001

(54) METHOD FOR PRODUCING CARBON FIBER, CARBON FIBER, PREPREG, AND MOLDED ARTICLE FROM FIBER-REINFORCED COMPOSITE MATERIAL

(75) Inventors: Shinichi Takemura; Yoshio Soda, both of Yokohama; Hideyuki Ohno, Tokyo; Yutaka Arai, Himeji; Tomohiro Nakanishi, Kimizu, all of (JP)

(73) Assignees: Nippon Mitsubishi Oil Corporation; Nippon Steel Corporation; Nippon Graphite Fiber Corporation, all of Tokyo (JP)

( * ) Notice: Under 35 U.S.C. 154(b), the term of this patent shall be extended for 0 days.

(21) Appl. No.: 09/316,246

(22) Filed: May 21, 1999

(30) Foreign Application Priority Data

May 22, 1998 (JP) ..... 10-140659

(51) Int. Cl.[7] ..... D01F 9/145

(52) U.S. Cl. ..... 428/357; 428/428; 428/392; 428/401; 442/442; 442/60; 423/447.6; 423/447.7; 423/447.8; 264/29.2; 264/29.6; 264/29.7

(58) Field of Search ..... 423/447.6, 447.7, 423/447.8; 264/29.2, 29.6, 29.7; 428/357, 364, 392, 401; 442/60

(56) References Cited

U.S. PATENT DOCUMENTS 5,595,720 * 1/1997 Arai et al. .

* cited by examiner

*Primary Examiner*—Richard Weisberger
(74) *Attorney, Agent, or Firm*—Scully, Scott, Murphy & Presser

(57) ABSTRACT

The resent invention provides a carbon fiber which enables a molded article produced from a fiber-reinforced composite material using the carbon fiber to exhibit excellent flexibility and to be freed from defects such as bending.

According to the method of the present invention the carbon fiber is produced by a two-stage infusibilizing process, namely carrying out a first-stage infusibilization of a pitch-based fiber, which is obtained from mesophase pitch having a softening point of 200 to 400° C. and a true density of 1.30 to 1.38 g/cm$^3$, in a mixed gas atmosphere having a nitrogen dioxide concentration of 1 to 5% by volume and an oxygen concentration of 5 to 50% by volume, the balance being an inert gas or steam, at a temperature between 100 and 200° C. and then carrying out a second-stage infusibilization of the product of the first-stage infusibilization in a mixed gas atmosphere having a nitrogen dioxide concentration of 0.1 to 5% by volume and an oxygen concentration of 5 to 40% by volume, the balance being an inert gas or a mixture of the inert gas and steam, at a temperature between 200 and 350° C.

4 Claims, No Drawings

METHOD FOR PRODUCING CARBON FIBER, CARBON FIBER, PREPREG, AND MOLDED ARTICLE FROM FIBER-REINFORCED COMPOSITE MATERIAL

FIELD OF THE INVENTION

The present invention relates to a method for producing a carbon fiber, the carbon, and a prepreg produced by impregnating the carbon fiber with an epoxy resin. The present invention also relates to a molded article produced from the fiber-reinforced composite material using the foregoing prepreg.

BACKGROUND OF THE INVENTION

Fiber-reinforced composite materials are used in many fields of sporting goods and equipment for leisure time amusement. One of the important characteristics of these sporting goods is lowness of elastic modulus, namely excellence in flexibility. For example, a flexible tennis racket prevents elbow pain, and a properly flexible fishing rod makes the hands smoothly feel a bite of fish and facilitates the taking-up of the fish. Also, in the case of a golf club, a club equipped with a shaft capable of holding flexibility is beneficial to amateurs and female golfers. Although their swing speed is slow, the use of such a club enables them to increase the head speed of the club so that a longer flying distance of ball is obtained because of the pliant suppleness of the shaft.

As stated above, in order to impart flexibility to a molded article produced from the fiber-reinforced composite material, a glass fiber or the like having a low tensile elastic modulus has been hitherto used. However, the use of a glass fiber is associated with disadvantages. For example, since the density of a glass fiber is larger than a carbon fiber or the like, the use of the glass fiber brings about increase in weight. Further, when a glass fiber and a carbon fiber are used in a combination, the difference in thermal expansivity between the two tends to cause defective products due to bending particularly in golf shafts, fishing rods, and the like.

OBJECTS OF THE INVENTION

The object of the present invention is to solve the problems of the prior art and to provide a method for producing a carbon fiber, which has excellent flexibility and does not cause molding defects such as bending and the like, the carbon fiber, a prepreg, and a molded article produced from the fiber-reinforced composite material.

SUMMARY OF THE INVENTION

First, the present invention relates to a method for producing a pitch-based carbon fiber, comprising carrying out a first-stage infusibilization of a pitch-based fiber, which is obtained from mesophase pitch having a softening point of 200 to 400° C. and a true density of 1.30 to 1.38 g/cm$^3$, in a mixed gas atmosphere having a nitrogen dioxide concentration of 1 to 5% by volume and an oxygen concentration of 5 to 50% by volume, the balance being an inert gas such as nitrogen or steam, at a temperature between 100 and 200° C.; and then carrying out a second-stage infusibilization of the product of the first-stage infusibilization in a mixed gas atmosphere having a nitrogen dioxide concentration of 0.1 to 5% by volume and an oxygen concentration of 5 to 40% by volume, the balance being an inert gas such as nitrogen or a mixture of the inert gas and steam, at a temperature between 200 and 350° C.

Second, the present invention relates to a pitch-based carbon fiber, preferably a continuous pitch-based carbon fiber, having a tensile elastic modulus of 9 to 16 tonf/mm$^2$, a density of 1.5 to 1.9 g/cm$^3$, a thermal expansion coefficient of $-0.8\times10^{-6}$ to 0.0/K, a diameter of 4 to 12 $\mu$m, a coefficient of water absorption of 0 to 4%, and a strain at compressive break of 1.7 to 5%.

Third, the present invention relates to a prepreg produced by impregnating the above-described carbon fiber with an epoxy resin.

Fourth, the present invention relates to a molded article produced from a fiber-reinforced composite material using at least as part thereof the above-described prepreg.

PREFERRED EMBODIMENTS OF THE INVENTION

The present invention will now be explained in more details.

Mesophase pitch, which is characterized by easy graphitization, can be used as a starting material of the carbon fiber of the present invention.

In the present invention, the mesophase pitch means a pitch which exhibits anisotropy under a polarizing microscope. Preferably, the mesophase pitch has an anisotropic phase content of 70 to 100%.

Examples of the mesophase pitch include coal-based pitch such as coal tar and coal tar pitch; liquefied coal pitch; ethylene tar pitch; petroleum-based pitch such as decanted oil pitch obtained from residual oil in fluidized catalytic cracking; and synthetic pitch produced from naphthalene or the like by using a catalyst or the like.

The softening point of the mesophase pitch for use in the present invention is preferably 200 to 400° C. and more preferably 250 to 350° C.

The true density of the mesophase pitch for use in the present invention is 1.30 to 1.38 g/cm$^3$ and preferably 1.31 to 1.36 g/cm$^3$.

If the density of the mesophase pitch for use in the present invention is below 1.30, the coefficient of water absorption of the carbon fiber to be obtained is unsuitably too large. To the contrary, if the density of the mesophase pitch for use in the present invention is above 1.38, the spinnability is undesirably reduced.

The carbon fiber of the present invention can be obtained by a process comprising extruding the mesophase pitch at a temperature, at which the pitch has a viscosity of 200 to 900 poise, from a nozzle having 1000 or more holes each constituting a capillary having a diameter of 0.05 to 0.12 mm by applying a pressure of about 5 to 40 kg/cm$^2$ while stretching the extruded pitch at a winding velocity of 100 to 500 m/min to obtain a pitch fiber bundle having a diameter of 5 to 15 $\mu$m and composed of 1000 to 100,000 filaments, infusibilizing the pitch fiber bundle thus obtained, and then thermally processing the infusibilized pitch fiber bundle.

If the spinning viscosity is below 200 poise, the crystal structure of the carbon fiber to be obtained is so coarse that an excellent compressive strength cannot be obtained. To the contrary, if the spinning viscosity is above 900 poise, the crystal system of the carbon fiber to be obtained is liable to be defective and therefore is not desirable from the standpoint of the expression of strength.

According to the method for producing a carbon fiber of the present invention, the infusibilizing process needs to comprise two or more stages described below each having a different infusibilization condition.

That is, a first-stage infusibilization is carried out in a mixed gas atmosphere having a nitrogen dioxide concentration of 1 to 5% by volume, preferably 1.5 to 5% by volume, and an oxygen concentration of 5 to 50% by volume, preferably 20 to 50% by volume, the balance being an inert gas such as nitrogen or steam, at a temperature between 100 to 200° C.

Further, a second-stage infusibilization is carried out in a mixed gas atmosphere having a nitrogen dioxide concentration of 0.1 to 5% by volume, preferably 0.2 to 2% by volume, and more preferably 0.2 to 1% by volume, and an oxygen concentration of 5 to 40% by volume, preferably 10 to 30% by volume, the balance being an inert gas such as nitrogen or a mixture of the inert gas and steam, at a temperature between 200 and 350° C. and preferably at a temperature between 210 and 350° C.

Particularly, it is preferable to lower the concentration of nitrogen dioxide and raise the temperature in the second-stage infusibilization, relative to the first-stage infusibilization.

In the thermal treatments, it is preferable to obtain primarily carbonized fiber bundles by carbonizing the infusibilized fiber bundles at a temperature between 350 and 850° C. in an inert gas atmosphere without loading any tension on the fibers.

Moreover,it is also possible to further thermally process the primarily carbonized fiber bundles in an inert atmosphere at 850 to 1700° C., preferably at 900 to 1500° C. while loading a tension of 0.1 to 5 gf/tex on the fiber bundles.

As a result of the above-described treatments, it is possible to obtain a pitch-based carbon fiber, preferably a continuous pitch-based carbon fiber, having a tensile elastic modulus of 9 to 16 tonf/mm$^2$, preferably 9 to 15 tonf/mm$^2$, a density of 1.5 to 1.9 g/cm$^3$, preferably 1.6 to 1.8 g/cm$^3$, a thermal expansion coefficient of $-0.8\times10^{-6}$ to 0.0/K, preferably $-0.8\times10^{-6}$ to $0.2\times10^{-6}$/K, a diameter of 4 to 12 $\mu$m, a coefficient of water absorption of 0 to 4%, and a strain at compressive break of 1.7 to 5%.

The carbon fiber thus obtained is characterized in that Lc(002) of the carbon fiber is 1.5 to 2.2 mm and the carbon fiber has a fine crystal structure; the carbon fiber exhibits a low elastic modulus and a large strain at compressive break; the domain size constituting fiber structure is not greater than 500 nm when the cross section of the carbon fiber is observed under a polarizing microscope; and the electrical resistivity of the carbon fiber is as small as 10 to 300 $\mu\Omega$m.

If the tensile elastic modulus of the fiber is greater than 16 tonf/mm$^2$, the flexibility of the molded article produced from the fiber-reinforced composite material is unfavorably lost. If the density of the fiber is greater than 1.9 g/cm$^3$, the weight of the molded article is unfavorably increased. If the thermal expansion coefficient of the fiber is greater than 0.0/K and if the fiber is used in combination with other fiber, the difference in thermal expansivity between the two fibers tends to cause defects such as bending in the molded articles. Further, if the diameter of the fiber is greater than 12 $\mu$m and a prepreg is produced by impregnating the fiber with a matrix resin, such disadvantages as reduction in the impregnating performance of the matrix resin, reduction in the smoothness of the prepreg surface, and loosening of the prepreg fiber mesh tend to occur.

In the carbon fiber having a low elastic modulus of the present invention, since carbon content is 90% or more, preferably 95% or more, and since the fiber itself has almost no active group, the fiber has a low coefficient of water absorption and excellent chemical resistance. Consequently, the composite material produced from the carbon fiber exhibits excellent chemical stability.

When a prepreg is produced by impregnating the carbon fiber with a matrix resin, the matrix resin is selected from conventional thermosetting resins which are exemplified by epoxy resins, unsaturated polyester resins, phenolic resins, silicone resins, polyurethane resins, urea resins, melamine resins, and others. Among these resins, most preferable is an epoxy resin because it can be used for general purposes.

The prepreg of the present invention may be a so-called tow prepreg in the form of a tow, a unidirectional prepreg having carbon fibers aligned in one direction, and a fabric prepreg in the form of a fabric.

When producing a molded article from the fiber-reinforced composite material using the prepreg, if it is desired to impart flexibility to the entire molded article, the prepreg can be used as a main component in combination with other reinforcing fiber having different physical properties such as tensile strength, tensile elastic modulus, thermal conductivity, thermal expansion coefficient, and the like.

Meanwhile, if it is desired to impart flexibility to a specific part of the molded article, the prepreg can be used in the specific part alone.

In the present invention, the coefficient of water absorption was measured in accordance with the following method. 10 g of fiber was cleaned with acetone. After the cleaning, the fiber was dried at 110° C. for 2 hours. Then, the fiber was cooled to room temperature in a desiccator and was weighed in an absolutely dry state. The weight was designated as A. Next, the sample, was left to stand in a cabinet having a constant humidity of 100% at 30° C. for 24 hours. After that, the sample was weighed, and the weight was designated as B. The coefficient C (%) was obtained based on the following formula.

$$C=(B-A)/A\times100$$

In the present invention, the strain at compressive break was measured in accordance with ASTM D3410 (or JIS K 7076).

EXAMPLES

The following examples are given by way of explanation but not by way of limitation.

Example 1

Coal tar pitch, from which quinoline-insoluble matters had been removed and which had a softening point of 80° C., was used as a starting material. In order to remove 45% of sulfur from the starting material, the material was hydrogenated at a temperature of 360° C. and a pressure of 120 kg/cm$^2$ in the presence of a hydrogenation catalyst. The hydrogenated coal tar pitch was thermally processed at a temperature of 400° C. and a reduced pressure of 40 mmHg for 5 hours and thus a pitch having a softening point of 160° C. was obtained. The thermally processed pitch was again thermally processed at a temperature of 510° C. and a pressure of 0.5 mmHg for 5 minutes and thus a pitch for spinning purpose was obtained. This pitch was mesophase pitch having a softening point of 300° C., a specific gravity of 1.35/cm$^3$, and a content of optically anisotropic phase of 90%. Then, using this pitch and a nozzle having 3000 holes each constituting a capillary having an inner diameter of 0.1 mm, a continuous pitch fiber bundle having a diameter of 12

μm and composed of 3000 filaments having a length of 18000 m was obtained by a spinning viscosity of 400 poise and a winding velocity of 400 m/min. The pitch fiber bundle was processed for 2 hours in a mixed gas atmosphere having a nitrogen dioxide concentration of 2% by volume and an oxygen concentration of 30% by volume, the balance being nitrogen, at a temperature between 120 and 200° C.; and was then processed for 2 hours in a mixed gas atmosphere having a nitrogen dioxide concentration of 0.4% by volume and an oxygen concentration of 10% by volume, the balance being nitrogen, at a temperature between 240 and 300° C., so that the total processing time was 4 hours. The infusibilized fiber thus obtained was carbonized in a nitrogen atmosphere at 700° C. without loading any tension on the fiber. The carbonized fiber bundle was then carbonized at 1000° C. by loading a tension of 0.6 gf/tex on the fiber bundle. In this way, a carbon fiber having a length of 15000 m and composed of 3000 filaments was obtained.

The carbon fiber had a tensile strength of 180 kgf/mm$^2$, an elastic modulus of 11.5 tonf/mm$^2$, a diameter of 9.8 μm, a density of 1.75 g/cm$^3$, a coefficient of moisture absorption of 1.2%, and a thermal expansion coefficient of $-0.42\times10^{-6}$/K at temperatures slightly above and below room temperature.

A composite material was produced from the carbon fiber obtained in the above-described procedure. The composite material had a compression strength of 115 kgf/mm$^2$ calculated in terms of vf60%, a compressive elastic modulus of 6.5 tf/mm$^2$, and a strain at compressive break of 2.1%. The Lc(002) was 1.9 nm according to Gakushin "Measuring Method for Lattice Constant and Crystalline Size of Artificial Graphite".

Comparative Example 1

Tar, which was obtained by distilling the decanted oil derived from residual oil in fluidized catalytic cracking and which had boiling points in the range of from 400 to point of 550° C. under normal pressure, was used as a starting material. The tar was thermally processed for 8 hours while being subjected to steam stripping at 420° C. and thus mesophasepitch was obtained. This pitch was mesophase pitch having a softening point of 300° C., a specific gravity of 1.30/cm$^3$, and a content of optically anisotropic phase of 98%. Then, using this pitch and a nozzle having 3000 holes each constituting a capillary having an inner diameter of 0.1 mm, a continuous pitch fiber bundle having a diameter of 12 μm and composed of 3000 filaments having a length of 9000 m was obtained by a spinning viscosity of 400 poise and a winding velocity of 400 m/min. The pitch fiber bundle was infusibilized in air for 3 hours at a temperature between 100 and 300° C. Subsequently, the infusibilized fiber bundle was carbonized in a nitrogen atmosphere at 700° C. without loading any tension on the fiber bundle. The carbonized fiber bundle was then carbonized at 1000° C. by loading a tension of 0.6 gf/tex on the fiber bundle. In this way, a carbon fiber composed of 3000 filaments was obtained.

The carbon fiber had a tensile strength of 110 kgf/mm$^2$, an elastic modulus of 8.9 tonf/mm$^2$, a diameter of 9.8 μm, a density of 1.58 g/cm$^3$, and a coefficient of moisture absorption of 5.3%.

A composite material was produced from the carbon fiber obtained in the above-described procedure. The composite material had a compressive strength of 54 kgf/mm$^2$ calculated in terms of Vf60%, a compressive elastic modulus of 5.9 tf/mm$^2$, and a strain at compressive break of 1.2%. The Lc(002) was 2.4 nm according to Gakushin "Measuring Method for Lattice Constant and Crystalline Size of Artificial Graphite".

Example 2

By using the carbon fiber obtained in Example 1, an epoxy resin-impregnated prepreg, in which the carbon fiber was used at a rate of 50 g/m$^2$ and an epoxy resin was used in a proportion of 40% by weight based on the total weight of the prepreg, was produced. The prepreg had no loose fiber mesh and was excellent in smoothness. Then, the prepreg was laminated on a mandrel, which had a diameter of 10 mm and a length of 1000 mm and had been coated with a wax, in 5 plies such that the carbon fiber direction of the prepreg and the longitudinal direction of the mandrel were the same. A heat-shrinkable tape was wound on the laminated article and thereafter the article was cured at 130° C. while being degassed. The pipe thus produced was free of voids The pipe had excellent surface smoothness and excellent flexibility.

Example 3

The prepreg in Example 2 was used in combination with P 9052F-12 (a prepreg manufactured by Toray Industries, Inc., reinforced with polyacrylonitrile-based carbon fiber M40J and having a tensile strength of 38.5 tonf/mm$^2$, a density of 1.77 g/cm$^3$, a thermal expansion coefficient of $0.0\times10^{-6}$/K, a carbon fiber content of 116 g/m$^2$, and an epoxy resin content of 33% by weight) in the following manner. First, P 9052F-12 (manufactured by Toray Industries, Inc.) was laminated on a tapered mandrel, which had a smaller diameter of 5 mm, a larger diameter of 15 mm, and a length of 1000 mm and had been coated with a wax, such that the carbon fiber direction of the prepreg and the longitudinal direction of the mandrel were nearly the same and such that the ply number continuously changed in the longitudinal direction of the mandrel from 3 plies on the smaller diameter side to 6 plies on the larger diameter side. Then, the prepreg of Example 2 was laminated on the P 9052F-12 (manufactured by Toray Industries, Inc.) such that the carbon fiber direction of the prepreg and the longitudinal direction of the mandrel were nearly the same and such that the ply number continuously changed in the longitudinal direction of the mandrel from 2 plies on the smaller diameter side to 4 plies on the larger diameter side. Next, a heat-shrinkable tape was wound on the laminated article and thereafter the article was cured at 130° C. while being degassed. The pipe thus produced was straight and free of bending.

Comparative Example 2

GE-100 (a prepreg manufactured by Nippon Steel Chemical Co., Ltd., reinforced with glass fiber and having a tensile strength of 7.5 tonf/mm$^2$, a density of 2.54 g/cm$^3$, and a thermal expansion coefficient of $5.0\times10^{-6}$/K), was used in combination with P 9052F-12 (a prepreg manufactured by Toray Industries, Inc., reinforced with polyacrylonitrile-based carbon fiber M40J and having a tensile strength of 38.5 tonf/mm$^2$, a density of 1.77 g/cm$^3$, a thermal expansion coefficient of $0.0\times10^{-6}$/K, a carbon fiber content of 116 g/m$^2$, and an epoxy resin content of 33% by weight) in the following manner. First, P 9052F-12 (manufactured by Toray Industries, Inc.) was laminated on a tapered mandrel, which had a smaller diameter of 5 mm, a larger diameter of 15 mm, and a length of 1000 mm and had been coated with a wax, such that the carbon fiber direction of the prepreg and the longitudinal direction of the mandrel were nearly the same and such that the ply number continuously changed in the longitudinal direction of the mandrel from 3 plies on the smaller diameter side to 6 plies on the larger diameter side. Then, GE-100 (a prepreg manufactured by Nippon Steel Chemical Co., Ltd.) was laminated on the P 9052F-12 (manufactured by Toray industries, Inc.) such that the carbon fiber direction of the prepreg and the longitudinal direction of the mandrel were nearly the same and such that the ply number continuously changed in the longitudinal direction of the mandrel from 2 plies on the smaller diameter side to 4 plies on the larger diameter side. Next, a heat-shrinkable tape was wound on the laminated article and thereafter the article was cured at 130° C. while being degassed. The pipe thus produced was bent and was distinctly inferior to the pipe of Example 3.

Comparative Example 3

Physical properties of a commercially available carbon fiber "Sornel p-25" were measured. The carbon fiber had a tensile strength of 180 kgf/mm$^2$, an elastic modulus of 16.5 tonf/mm$^2$, a diameter of 10.8 $\mu$m, and a density of 1.93 g/cm$^3$.

A composite material was produced from the carbon fiber. The composite material had a compression strength of 88 kgf/mm$^2$ calculated in terms of vf60%, a compression elastic modulus of 7.4 tf/mm$^2$, and a strain at compressive break of 1.48%. The Lc(002) was 3.2 nm according to Gakushin "Measuring Method for Lattice Constant and Crystalline Size of Artificial Graphite".

Effects of the Invention

As have been described above, the present invention provides a method for producing a carbon fiber, which has excellent flexibility and does not cause molding defects such as bending and the like, the carbon fiber, a prepreg, and amolded article produced from the fiber-reinforced composite material.

What is claimed is:

1. A method for producing a pitch-based carbon fiber, comprising carrying out a first-stage infusibilization of a pitch-based fiber, which is obtained from mesophase pitch having a softening point of 200 to 400° C. and a true density of 1.30 to 1.38 g/cm$^3$, in a mixed gas atmosphere having a nitrogen dioxide concentration of 1 to 5% by volume and an oxygen concentration of 5 to 50% by volume, the balance being an inert gas or steam, at a temperature between 100 and 200° C.; and then carrying out a second-stage infusibilization of the product of the first-stage infusibilization in a mixed gas atmosphere having a nitrogen dioxide concentration of 0.1 to 5% by volume and an oxygen concentration of 5 to 40% by volume, the balance being an inert gas or a mixture of the inert gas and steam, at a temperature between 200 and 350° C.

2. A pitch-based carbon fiber having a tensile elastic modulus of 9 to 16 tonf/mm$^2$, a density of 1.5 to 1.9 g/cm$^3$, a thermal expansion coefficient of $-0.8\times10^{-6}$ to 0.0/K, a diameter of 4 to 12 $\mu$m, a coefficient of water absorption of 0 to 4.0%, and a strain at compressive break of 1.7 to 5%.

3. A prepreg produced by impregnating the carbon fiber of claim 2 with an epoxy resin.

4. A molded article produced from a fiber-reinforced composite material using at least as part thereof the prepreg of claim 3.

* * * * *